US006340523B1

(12) United States Patent
Fischer et al.

(10) Patent No.: US 6,340,523 B1
(45) Date of Patent: Jan. 22, 2002

(54) PROCESS FOR PRODUCING HIGH STRENGTH, HIGH SHRINKAGE NYLON 66 FILAMENT YARN

(76) Inventors: Klaus Fischer, Rosenberghalde 2, CH-6004 Luzern; Hans Linz, Guetrutiweg 2, CH-6010 Kriens; Luzius Berger, Rosenstrasse 19, CH-6010 Kriens, all of (CH)

( * ) Notice: Subject to any disclaimer, the term of this patent is extended or adjusted under 35 U.S.C. 154(b) by 0 days.

(21) Appl. No.: 09/427,605

(22) Filed: Oct. 27, 1999

(30) Foreign Application Priority Data

Aug. 24, 1995 (CH) ..... 2415/95

(51) Int. Cl.[7] ..... D01F 6/60

(52) U.S. Cl. ..... 428/364; 428/395

(58) Field of Search ..... 426/364, 395

(56) References Cited

U.S. PATENT DOCUMENTS 5,077,124 A * 12/1991 Clark, III et al. ..... 428/364
5,106,946 A * 4/1992 Clark, III et al. ..... 528/335
5,139,779 A * 8/1992 Clark, III et al. ..... 264/289.6
5,707,733 A * 1/1998 Kurt et al. ..... 428/395

* cited by examiner

*Primary Examiner*—Newton Edwards

(57) ABSTRACT

A nylon 66 filament yarn having a tenacity of at least 60 cn/tex, an elongation of 10 to 25% and a hot air shrinkage of 7–11% (160 C).

1 Claim, 1 Drawing Sheet

PROCESS FOR PRODUCING HIGH STRENGTH, HIGH SHRINKAGE NYLON 66 FILAMENT YARN

BACKGROUND OF THE INVENTION

The invention relates to nylon 66 filament yarn.

High shrinkage thermoplastic filaments are typically wound onto cops with a protective twist suitable for the further processing. The disadvantage of winding onto cops is that the maximum winding speeds are only of the order of a few hundred metres per minute. A further disadvantage of winding onto cops is that the yarn capacity of a drawn cop is generally limited to about 4 kg of yarn. Economical yarn manufacture is no longer guaranteed after such a process. It would be desirable to wind high shrinkage yarns directly onto cylindrical bobbins. However, it has hitherto not been possible to wind thermoplastic polymer yarns possessing high hot air shrinkage. Such yarn has to be wound up under relatively high tension in order that an undesirable reduction in the hot air shrinkage may be prevented. This has serious disadvantages for the package build. The high yarn tension creates such high radial forces within the cross-wound package that, on the one hand, the package centres are deformed, so that the full package cannot be removed from the mandrel of the winding machine. A further disadvantage is, on the other hand, that unacceptable winding deformations are observed, which make it impossible to build full packages.

DE-A-34 37 943 discloses a process for producing nylon 66 filament yarn wherein an undrawn yarn of polyhexamethyleneadipamide having a relative viscosity of 60 to 100 in formic acid is drawn in one or two stages. The apparatus suitable for this purpose consists of a plurality of heated draw roll units. To improve the drawability of the yarn additional heat sources in the form of contact heaters are provided between the draw rolls. It is known that, in the melt-spinning process, at a winding speed of 4500 m/min and higher, the winding tension is so high that it is no longer possible to remove a paper centre from the winding machine. The problem is solved in this process by relaxing by about 10%. Nothing is said about the winding of the drawn yarn. The known yarns are wound up at speeds of not more than 20 m/min. The aim of the known process is the production of dimensionally stable filament yarns for tyre cord fabrics, possessing high strength, high elongation and low shrinkage, ideally below 5%. The drawing conditions and especially the winding conditions onto cheeses are optimized for these yarns.

Lately, however, airbag fabrics specifically are increasingly produced using yarns having high hot air shrinkage. It is true that such yarn types are easy to produce, but they are difficult to wind onto cheeses.

SUMMARY OF THE INVENTION

It is an object of the invention to produce high strength nylon 66 filament yarn having high shrinkage and make it available on a cheese.

It is a further object to improve not only the production speed but also the unit weight of the yarn packages and thus the economics of the drawing and winding process. Equipment for producing cylindrical packages permit production speeds of several thousand metres per minute.

The object is achieved according to the invention when, the nylon 66 filament yarn has a relative viscosity (RV) of ≧40, measured in 90% strength formic acid in accordance with ASTM 0789-81, a tenacity of at least 60 cN/tex, an elongation of 10–25% and a hot air shrinkage at 160° C. of 7–11%, and has been wound up as a cheese bearing a yarn mass of at least 6 kg. It has surprisingly been possible to wind such a high shrinkage polyamide yarn as 6 kg packages instead of the uneconomical cops having a maximum capacity of just 4 kg.

The nylon 66 filament yarn of the invention is suitable for industrial fabrics, especially airbag fabrics, which are to combine a high tenacity with a particularly high hot air shrinkage.

BACKGROUND OF THE INVENTION

DESCRIPTION OF PREFERRED EMBODIMENTS

Figure 1:
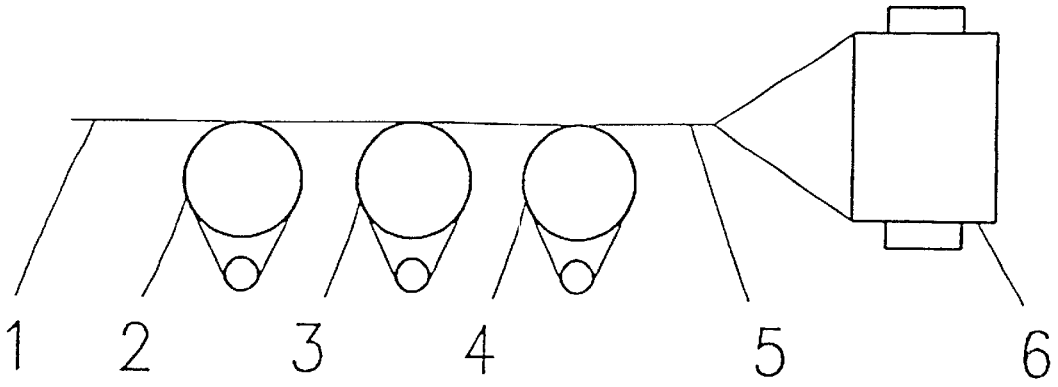
FIG. 1 is a schematic representation of the process of the invention.

In FIG. 1, reference numeral 1 designates an undrawn nylon 66 LOY filament yarn. The filament yarn is passed by a delivery roll (not shown) to a first heated draw roll unit 2. Between the delivery roll and the first draw roll unit 2 the undrawn filament yarn 1 is slightly elongated by about 3% in order that it may acquire a minimal tension. The yarn tension has to be chosen so as to ensure sufficient friction between the filament yarn 1 and the surface of draw roll unit 2 in order that the requisite resistance may be provided against the drawing force arising in the first drawing stage. A first drawing operation takes place between a second heated draw roll unit 3 at about 180° C. and the first draw roll unit 2. The heated draw roll unit 3 is followed by a third draw roll unit 4 which has a surface temperature of 70° C. to 150° C. and provides a further, second drawing operation.

After drawing, the drawn filament yarn 5 is wound onto a cheese 6. To reduce the yarn tension, the filament yarn is wound up at a speed which is set about 6% lower than the speed of unit 4. This adjusts the winding tension to 0.13 cN/dtex, for example. All the draw roll units are multiply wrapped by filament yarn 1 in order, on the one hand, to ensure the necessary friction for drawing and, on the other, to ensure adequate heat transfer between the heated roll surfaces and filament yarn 1.

Figure 2:
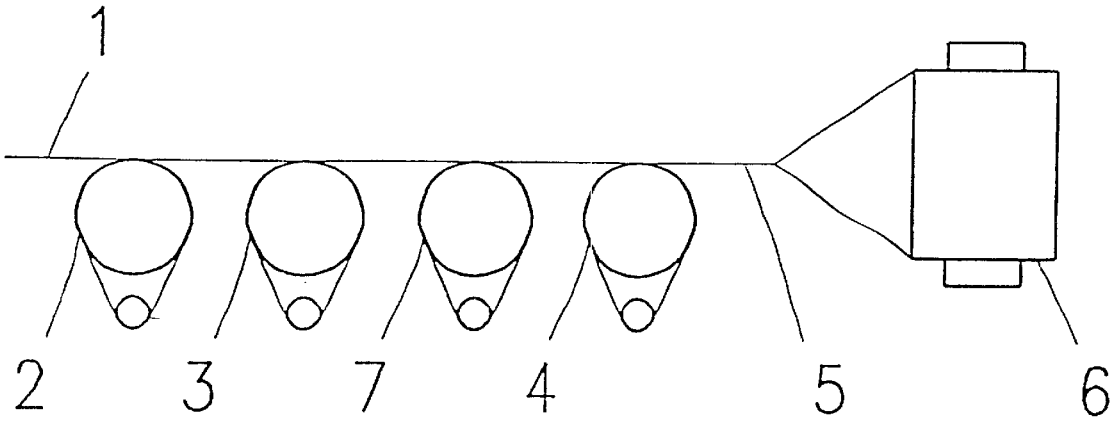
FIG. 2 is a schematic representation of a variant of the process of the invention.

FIG. 2 differs from FIG. 1 in featuring an additional draw roll unit 7. In the process of this variant, draw roll unit 7 is heated to 180° C., for example. In this case, the second drawing operation is carried out between draw roll units 3 and 7, whereas the temperature of draw roll unit 4 is not changed compared with the arrangement in FIG. 1. And the speed of draw roll unit 4 is at least as high as that of draw roll unit 7.

The apparatus of FIG. 1 is exemplary and not exclusively suitable for carrying out the process. An apparatus suitable for the process can also consist of godet duos instead of the draw roll units with separating rollers. Furthermore, further elements for the thermal treatment of the yarn such as block or radiative heaters, hot air or steam nozzles can be disposed between the units. It is further advantageous to subject the yarn which is to be wound up to an intermingling operation by means of an air jet or the like in order that its further processibility may be improved as a result.

This apparatus is not just suitable for one filament yarn; in the case of relatively fine yarns, for example at a linear density of 470 dtex or less, two or more filament yarns at a time can be drawn and wound up on an appropriately multiend winding machine.

The operating speed of this apparatus is within the range between 300 and 3000 m/min. The apparatus is thus significantly more productive than conventional draw-twist machines, which wind the yarn on cops. Furthermore, cheeses having a yarn mass of more than 10 kg can be produced. This requires significantly fewer manipulations than processing into cops of not more than 4 kg. The high operating speed restricts its utility not just to the drawing of already wound LOY filament yarn. In principle the apparatus is also suitable for use in an integrated spin-draw process.

High strength yarns of low hot air shrinkage are customarily relaxed before being wound up. Relaxation is generally accomplished by using an additional godet unit whose speed is lower than that of the last draw roll unit by a defined amount. However, it is also possible to effect the yarn shortening directly within the winding operation by winding up at a speed which is lower than that of the last draw godet.

To produce a high shrinkage yarn, the relaxation of the yarn has to be kept to a minimum, in contradistinction to the conventional technique. The problem is thus to provide a process for winding up a highly unrelaxed yarn. In theory this can be done by setting the winder speed equal to or just below that of the last godet unit. However, this entails very high yarn tensions under which it is generally not possible to build a cheese.

The examples which follow illustrate the process.

EXAMPLE 1 (Comparative)

A nylon 66 LOY filament yarn having a relative viscosity (RV) of 45 in formic acid and an as-spun linear density of 1270 dtex was fed in two ends through the apparatus of FIG. 1. The filament yarn was drawn in two stages to a ratio of 5.3:1 under the conditions specified in Table 1 to arrive at a linear density of 235 dtex and relaxed by 6.8% within the winding zone, i.e. between draw roll unit 4 and cheese 5. The temperature of the last draw unit was 230° C. The resulting filament yarn had a tenacity of 74.5 cN/dtex, an elongation at break of 22% and a 160° C. hot air shrinkage of 3.6%. However, it is unsuitable for specific applications, for example for airbag fabric applications, because of the low hot air shrinkage.

EXAMPLE 2 (Comparative)

A nylon 66 LOY filament yarn having a relative viscosity (RV) of 45 in formic acid and a high hot air shrinkage suitable for airbag fabrics was produced under essentially the same drawing conditions as in Example 1 by reducing the temperature of the last draw godet to 160° C. The relaxation ratio was insignificantly reduced to 5.7% compared with Example 1. The resulting yarn had a tenacity of 72 cN/tex, an elongation at break of 16.6% and a 160° C. hot air shrinkage of 9.2%.

However, the untenable disadvantage of this process was that, as a result of the reduction in the temperature of the last draw godet, the winding tension was so high at 0.38 cN/dtex that acceptable packages could not be built. Even when as little as 1.5 kg of yarn had been wound on, the packages were so strongly deformed and bulged out at the flanks that they protruded beyond the yarn tube supports on both sides. Such a package is unsuitable not only for shipping but also for unwinding, for example in weaving.

EXAMPLE 3 (Inventive)

A nylon 66 LOY filament yarn having a relative viscosity (RV) of 45 in formic acid and a high hot air shrinkage suitable for airbag fabrics was produced under essentially the same drawing conditions as in Example 1 by reducing the temperature of the last draw godet to 105° C. The relaxation ratio was insignificantly reduced to 6.5% compared with Example 1. The resulting yarn had a tenacity of 74.2 cN/tex, an elongation at break of 17.4% and a 160° C. hot air shrinkage of 9.0%. With this setting the winding tension was surprisingly only 0.13 cN/dtex as in Example 1. In this way it presented no problems to produce cheeses bearing 7.5 kg of yarn. The appearance of these packages was good: the flanks were straight and there were no shoulders at the periphery.

EXAMPLE 4 (Inventive)

Two PA 66 filament yarns having a starting linear density of 2540 dtex were conjointly drawn in two stages by the procedure of Example 3 to a draw ratio of 5.4. The temperature of draw roll unit 4 was reduced to 90° C. A winding tension of 0.074 cN/dtex was measured coupled with a relaxation ratio of 7.5%. The packages held a yarn mass of 10.3 kg and were satisfactory with straight flanks and no shoulders at the periphery. The drawn yarn had the properties shown in Table 1.

Table 1 below shows the parameters of the process of the invention on a drawing machine with three heated draw roll units, godets with separating roll, drawing being carried out in two stages at a final speed of 800 m/min to 5.4 times the original length. The yarn properties are indicated in the same table.

TABLE 1

| Example | 1 | 2 | 3 | 4 |
|---|---|---|---|---|
| Process parameter: | | poor | | |
| Drawing speed [m/min] | 800 | 800 | 800 | 800 |
| Temp. last godet [°C.] | 230 | 160 | 105 | 90 |
| Draw ratio | 5.3 | 5.4 | 5.4 | 5.4 |
| Relaxation ratio [%] | 6.8 | 5.7 | 6.5 | 7.5 |
| Winding tension [cN/dtex] | .13 | .38 | .13 | .074 |
| Yarn mass per package [kg] | 7.5 | 1.5 | 7.5 | 10.3 |
| Package build: | good | poor | good | good |
| Yarn properties: | | | | |
| Linear density [dtex] | 235 | 235 | 235 | 470 |
| Tenacity [cN/tex] | 74.5 | 72.0 | 74.2 | 74.2 |
| Elongation at break [%] | 22 | 16.6 | 17.4 | 18.7 |
| Hot air shrinkage 160° C. [%] | 3.6 | 9.2 | 9.0 | 9.3 |

The apparatus of the invention has two significant advantages over existing apparatus. First, two or more ends at a time can be drawn and wound and, secondly, the production speed can be increased compared with conventional draw-twisting because of the more productive winding onto cheeses. The yarn of the invention is particularly useful for manufacturing airbag fabrics.

What is claimed is:

1. A nylon 66 filament yarn for industrial fabrics, characterized in that the nylon 66 filament yarn has a tenacity of at least 60 cN/tex, an elongation of 10 to 25% and a hot air shrinkage of 7–11% (160° C.) and has been wound in an amount of at least 6 kg onto a package centre (cheese).

* * * * *